United States Patent [19]

Huet

[11] Patent Number: 4,714,588

[45] Date of Patent: Dec. 22, 1987

[54] ALUMINUM ALLOY HAVING IMPROVED PROPERTIES

[75] Inventor: Roger Huet, Grenoble, France

[73] Assignee: Aluminum Company of America, Pittsburgh, Pa.

[21] Appl. No.: 683,851

[22] Filed: Dec. 20, 1984

[51] Int. Cl.[4] ..... C22C 21/02

[52] U.S. Cl. ..... 420/534; 420/535

[58] Field of Search ..... 420/534, 530, 532, 535, 420/536; 148/417, 439

[56] References Cited

U.S. PATENT DOCUMENTS

| | | | |
|---|---|---|---|
| 1,848,816 | 3/1932 | Archer et al. | 420/534 |
| 3,314,829 | 4/1967 | Sunnucks | 148/32.5 |

FOREIGN PATENT DOCUMENTS

| | | |
|---|---|---|
| 595214 | 11/1947 | United Kingdom . |
| 1436069 | 5/1976 | United Kingdom . |
| 82219 | 12/1963 | U.S.S.R. . |
| 502968 | 2/1976 | U.S.S.R. . |

OTHER PUBLICATIONS

Registration Record of Aluminum Association Alloy Designations and Chemical Composition Limits for Aluminum Alloys in the Form of Castings and Ingot, the Aluminum Association, Jan., 1984.

Chemical Compositions and Mechanical and Physical Properties of SAE Aluminum Casting Alloys—SAE J453c, Report of Nonferrous Metals Division Approved Jan. 1939 and Last Revised by Nonferrous Metals Committee, Jul. 1973, pp. 11.08–11.10.

*Primary Examiner*—R. Dean

*Attorney, Agent, or Firm*—Daniel A. Sullivan, Jr.

[57] ABSTRACT

The present invention concerns a novel aluminum alloy. This alloy contains:

| | |
|---|---|
| Si | 6.5 to 7.5 |
| Mg | 0.20 to 0.70% |
| Cu | 1.0 to 1.6% |

the remainder being constituted by aluminum and impurities the content of which is lower than 1.0%.

It also concerns an aluminum alloy having improved properties.

4 Claims, 1 Drawing Figure

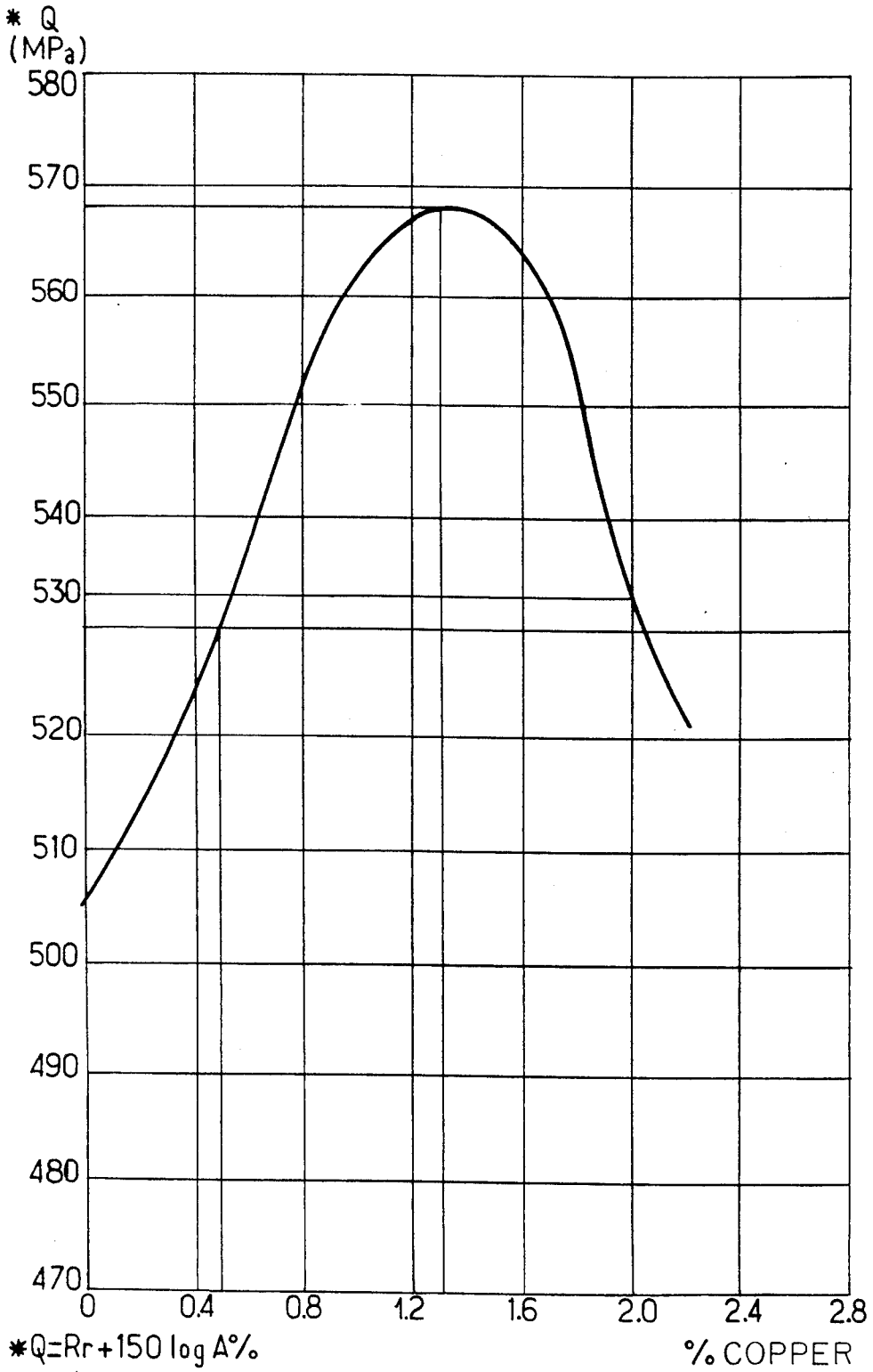
* Q
(MPa)
580
570
560
550
540
530
520
510
500
490
480
470
0
0.4
0.8
1.2
1.6
2.0
2.4
2.8
*Q=Rr+150 log A%
% COPPER

ALUMINUM ALLOY HAVING IMPROVED PROPERTIES

BACKGROUND OF THE INVENTION

The present invention concerns an aluminum-based alloy presenting simultaneously improved mechanical properties and excellent welding and desirable operating properties. It also concerns the application of this aluminum alloy to the manufacture of founded pieces as well as the castings that are formed therefrom.

A certain number of aluminum-based alloys are already known containing various other metals such as Si, Mg, etc., each of these metals having a defined effect on the alloy obtained. Thus, it is known that the presence of silicon in aluminum-based alloys causes an increase in mechanical properties and facilitates their use from a practical point of view.

It is also known that the presence of magnesium in aluminum-based alloys containing Si, Cu, or Zn allows these alloys to be subjected to thermal treatments that lead to improvement in mechanical properties.

Thus, a casting alloy designated A357.0, also known as Al-Si7Mg0.6, presents good mechanical properties and has only a slight tendency toward shrinkage cracking, i.e. forming intercrystalline shrinkage cracks in the face of the volume contraction that occurs during solidification of the alloy.

SUMMARY OF THE INVENTION

It is an object of the invention to provide an aluminum alloy having mechanical properties exceeding those of A357.0.

This as well as other objects which will become apparent in the discussion that follows are achieved, according to the present invention, by an aluminum-based alloy consisting essentially of:

| | |
|---|---|
| silicon | 6.5 to 7.5% |
| magnesium | 0.20 to 0.7% |
| copper | 1.0 to 1.6% |

the remainder being constituted of aluminum and impurities, the impurity content being less than 1%.

Compositions herein are weight percentages, unless noted otherwise.

It is surprising that the copper, whose positive effect on the increase of the mechanical properties of aluminum-based alloys is known, but for which it is also known that this increase occurs to the detriment of the operating and welding properties of the alloys obtained, when added in defined proportions to an aluminum-based alloy containing silicon and magnesium, can lead to a practical maintenance of the welding and operating properties. This surprising and unexpected observation is a basis of the present invention.

It was, furthermore, not obvious that the addition of copper to the known compositions would simultaneously allow:

avoidance of shrinkage cracking in the alloy obtained; it is known, in fact, that the addition of copper to this type of alloy increases the risk of shrinkage cracking during solidification upon cooling of the alloy;

no interference with the properties of the alloy, including its resistance to intercrystalline corrosion, both normal and under mechanical tension.

BRIEF DESCRIPTION OF THE DRAWING

The sole FIGURE is a graph of quality index Q versus copper content for the alloy of the invention.

DESCRIPTION OF THE PREFERRED EMBODIMENTS

According to one embodiment of the invention, the specified alloy contains from 1.0 to 1.5%, preferably 1.2 to 1.4% copper.

A preferred alloy according to the invention contains:

| | |
|---|---|
| silicon | 7% |
| magnesium | 0.6% |
| copper | 1.3% |

and can be represented by the following formula Al-Si7Cul.3Mg0.6.

The impurities are maintained at the lowest possible industrial level, i.e. the iron has a maximum value of 0.10% and the phosphorus concentration remains below 5 ppm.

Other impurities, such as Mn and Zn, are maintained below 0.10%.

Ti content is comprised between 0.10 and 0.30% in order to realize an adequate grain refining allowing for good mechanical properties after solidification and suitable thermal treatment. The following Table gives the composition limits for the constituents of the alloy according to the invention, as well as an alloy composition according to a preferred embodiment.

| | Minimum Content | Maximum Content | Preferred Content |
|---|---|---|---|
| Al | remainder | remainder | remainder |
| Fe | 0 | 0.10 | minimum |
| Si | 6.5 | 7.5 | 7 |
| Cu | 1.0 | 1.6 | 1.3 |
| Zn | 0 | 0.10 | minimum |
| Mg | 0.20 | 0.80 | 0.60 |
| Mn | 0 | 0.10 | minimum |
| Ni, Pb, Sn | 0 | 0.10 | minimum |
| Ti | 0.10 | 0.30 | 0.20 |
| Sb | 0 | 0.30 | 40 ppm |

Antimony may be replaced by other known modifiers for controlling the fineness of the eutectic.

The FIGURE shows the quality index Q of a sample of the aluminum alloy as a function of the copper content, this aluminum alloy, besides impurities, containing:

| | |
|---|---|
| Si | 7% |
| Mg | 0.6% |

The quality index is calculated using the following formula:

$$Q = R_r + 150 \log_{10} A\%$$

with:

$R_r$ = tensile strength

A% = elongation, based on a tensile specimen machined to diameter of 13.8 plus/minus 0.09 millimeters over sufficient distance, e.g. 77 to 98 mm, to encompass the gage length of five times the diameter $R_r$ and Q are expressed in MPa.

The quality index is a particularly useful concept. Once Q is known for a given alloy, the above relationship between Q, $R_r$ and A% can be used to predict either tensile strength for a given elongation or, alternatively, elongation for a given tensile strength. For example, if precipitation hardening to a certain tensile strength is desired for some application, knowledge of the Q for the particular alloy permits calculation of the elongation which can be expected. Further information on quality index is to be found in "Interpretation of Tensile Results by Means of Quality Index and Probable Yield Strength" by M. Drouzy, S. Jacob, and M. Richard, *AFS International Cast Metals Journal,* June, 1980, pages 43–50; "Le Diagramme Charge De Rupture - Allongement Des Alliages D'Aluminium" by M. Drouzy, S. Jacob, and M. Richard, *Fonderie,* 355, April, 1976, pages 139–147; and "Conseils Pratiques aux Fondeurs" by M. Drouzy, *Fonderie,* 402, October, 1980, pages 337–338.

It will be observed in the FIGURE that for the alloy Al-Si7Mg0.6 the quality index is 506 MPa, whereas for an aluminum alloy having the same Si and Mg contents and containing 1.0 to 1.6% copper, the quality index is higher than 560 and can reach 580 MPa.

The quality index is thus 10% higher when the above-mentioned alloy contains from 1.0 to 1.6% copper; this is perfectly unexpected and totally surprising.

It should be noted that for an alloy having the preferred content mentioned in the above Table, thus of the type Al-Si7Cul.3Mg0.6 the quality index is close to maximum.

For the alloys having Q's between 500 and 600 MPa in FIG. 1, tensile strengths can be greater than 400 MPa. Elongations are between 5 and 10%. Thus, artificial aging between 150° and 155° C. for 8 hours gives elongations of about 10%, whereas aging at 170° C. for the same time leads to a reduction of elongation while giving tensile strengths greater than 400 MPa.

The alloy according to the present invention and in particular the preferred alloy mentioned above presents improved casting properties that render said alloys particularly useful for the manufacture of articles by casting techniques. The alloy is also very weldable which renders advantageous the subsequent assemblage of these articles. This provides much better metallurgical characteristics than those already observed for the best alloys used until now in the aeronautics industry. These exceptional characteristics can lead to the manufacture of castings for the automobile industry or the aeronautics industry. Additionally, the alloy of the invention can be cast into very cold molds and need not undergo further aging treatment in order to present metallurgical properties far superior to those of currently existing alloys. In the Table below are given, by way of comparison, mechanical properties and quality indices of two alloys obtained by casting under identical operating conditions involving a thermal treatment according to U.S. Standard T6, namely:

an alloy A357.0 of formula Al-Si7Mg0.6 an alloy according to the invention of formula Al-Si7-Cul.3Mg0.6

These measurements were made on casting characterization samples according to the method described in French Standard AIR 3380C.

| Alloy | Aging | Tensile (MPa) | Yield 0.2 (MPa) | E-long. % | HBN | Q (MPa) |
|---|---|---|---|---|---|---|
| Al—Si7Mg0.6 | B | 340 | 300 | 3 | 110 | 410 |
| Al—Si7Cul.3Mg0.6 | B | 370 | 320 | 4 | 125 | 460 |

In the Table herein-above, the different symbols have the following significations:

Yield 0.2=yield strength, 0.2% offset (as calculated by the formula $R_r-60\log_{10}A\%-13$).

HBN=Brinell hardness.

Q=quality index.

An advantage of the invention is that Be is not needed in its composition.

While the invention has been described in terms of preferred embodiments, the claims appended hereto are intended to encompass all embodiments which fall within the spirit of the invention.

What is claimed is:

1. An aluminum alloy consisting essentially of about the following percentages of materials:

| | |
|---|---|
| Si | 6.5 to 7.5% |
| Mg | 0.50 to 0.70% |
| Cu | 1.2 to 1.4% |

the remainder being constituted by aluminum, grain refiner and impurities the content of which is lower than 1.0%.

2. Aluminum alloy according to claim 1 containing:

| | |
|---|---|
| Si | 7% |
| Mg | 0.60% |
| Cu | 1.3% |

3. Alloy according to claim 1 wherein the impurities comprise:

| | |
|---|---|
| Fe | <0.1% |
| Zn | <0.1% |
| Mn | <0.1% |
| Ni | <0.01% |
| Pb | <0.01% |
| Sn | <0.01% |
| P | <5 ppm |

4. A casting formed of an alloy as claimed in claim 1.

* * * * *